US006435151B1

(12) United States Patent
Yamaura et al.

(10) Patent No.: US 6,435,151 B1
(45) Date of Patent: Aug. 20, 2002

(54) DECOMPRESSOR FOR FOUR-STROKE CYCLE ENGINE

(75) Inventors: Hiroshi Yamaura; Koichi Tsutsumi; Yasuo Shimura, all of Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/712,939

(22) Filed: Nov. 16, 2000

(30) Foreign Application Priority Data

Nov. 18, 1999 (JP) ..... 11-328888

(51) Int. Cl.[7] ..... F01L 13/08
(52) U.S. Cl. ..... 123/182.1
(58) Field of Search ..... 123/182.1, 90.16, 123/90.17

(56) References Cited

U.S. PATENT DOCUMENTS 4,790,271 A * 12/1988 Onda ..... 123/182.1

FOREIGN PATENT DOCUMENTS

| | | | |
|---|---|---|---|
| DE | 37 15 395 A1 | | 11/1987 |
| JP | 452413 | | 12/1992 |
| JP | 6-146938 A | * | 5/1994 |

* cited by examiner

*Primary Examiner*—Andrew M. Dolinar
*Assistant Examiner*—Arnold Castro
(74) *Attorney, Agent, or Firm*—Birch, Stewart, Kolasch & Birch, LLP

(57) ABSTRACT

A projection is formed on the outer circumference of an annular member and a stopping member is attached to a cylinder head supporting a camshaft thereon. A side surface of the projection comes into contact with a side surface of the stopping member to restrain a decompression cam from turning when the camshaft rotates in the normal direction. The stopping member does not apply any pressure to the annular member in a radial direction and the annular member does not exert any force on the camshaft. Consequently, frictional resistance against the rotation of the camshaft can be reduced and a loss in the output of the engine can be suppressed.

12 Claims, 6 Drawing Sheets

FIG. 4
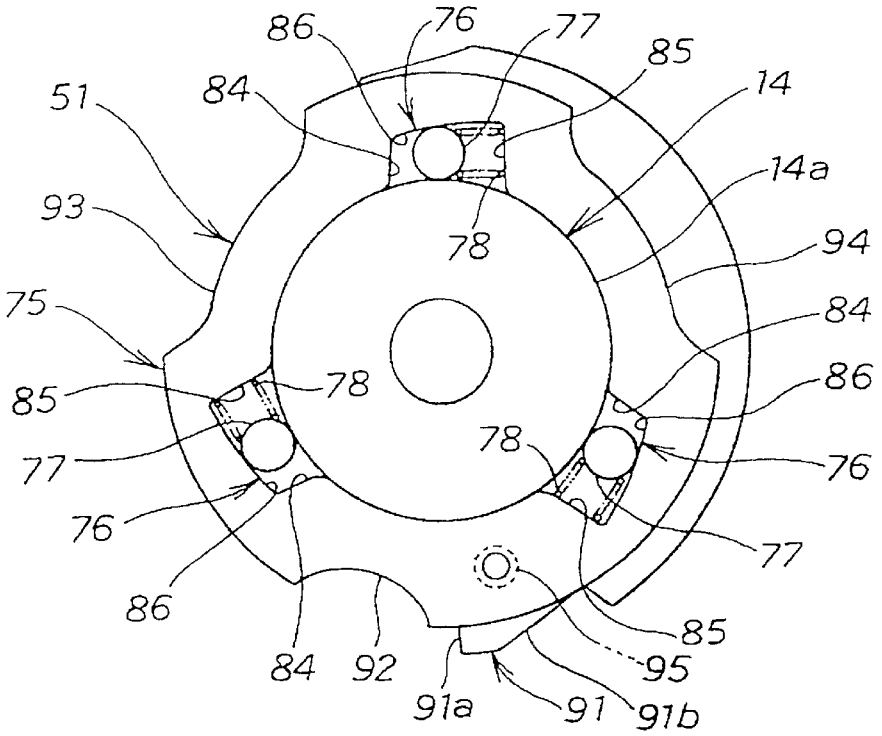
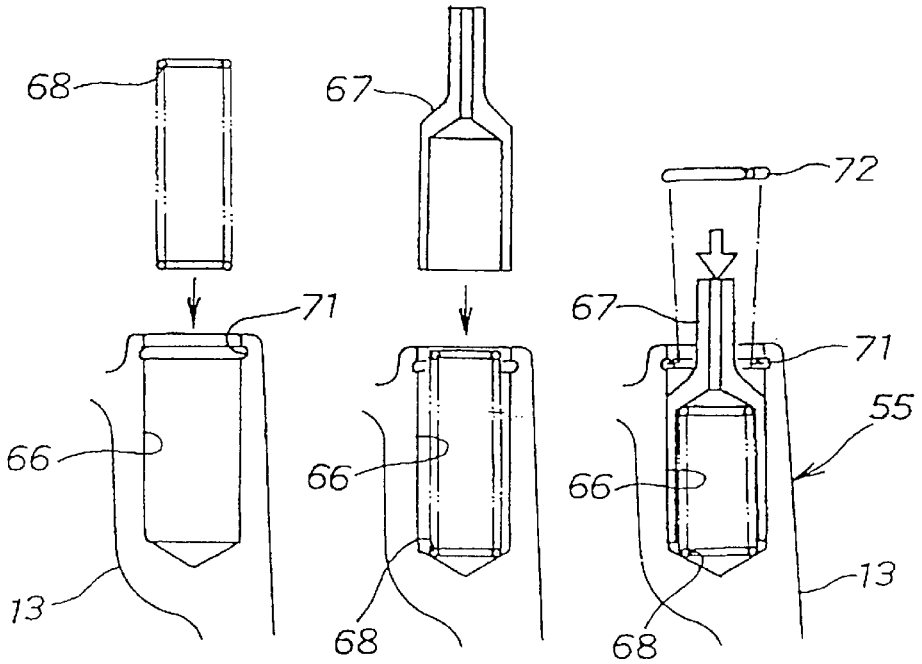
FIG. 5(a) FIG. 5(b) FIG. 5(c)

DECOMPRESSOR FOR FOUR-STROKE CYCLE ENGINE

BACKGROUND OF THE INVENTION

1. Field of the Invention

The present invention relates to a decompressor suitable for reducing a load on an engine starting system.

2. Description of Background Art

When starting an engine by forcibly rotating the crankshaft of the engine to introduce fuel into a combustion chamber and to produce a high pressure in the combustion chamber by a piston connected to the crankshaft by a connecting rod and by igniting a mixture contained in the combustion chamber, it sometimes occurs that the piston is moved by the pressure in the combustion chamber to force the crankshaft to rotated in the reverse direction. In such a case, a torque acts on the crankshaft in the reverse direction and increases the load on a starting system.

A decompressor previously proposed to reduce a load on the starting system opens the exhaust valve forcibly when the crankshaft reverses to reduce the pressure produced in the compression chamber by compressing the mixture so that the fuel supplied into the combustion chamber may not be ignited. A reduction of the pressure in the combustion chamber is called "decompression."

Such a decompressor is disclosed in, for example, Japanese Utility Model No. H4-52413, "Automatic Decompressor for Four-Stroke Cycle Engine." As shown in FIGS. 8 and 9 appended to the specification for Japanese Utility Model No. H4-52413, a four-stroke cycle engine has a positioning plunger 54 engaged with an engaging member 52.

According to the prior art, the positioning plunger 54 is pressed by a coil spring into engagement with the engaging member 52. Consequently, a decompression cam 50 is pressed against a camshaft 12 by the resilience of the coil spring and hence the stationary decompression cam 50 exerts a frictional resistance on the rotating camshaft 12. This frictional resistance causes a loss in the output of the engine. Therefore, it is desired to reduce the frictional resistance to the least possible extent.

Although the plunger 54 is maintained in contact with the decompression cam 50 at all times by the coil spring, sometimes, the plunger 54 and the decompression cam 50 are caused to vibrate and strike against each other by vibrations generated by the engine, so that noise is generated.

SUMMARY AND OBJECTS OF THE INVENTION

Accordingly, it is an object of the present invention to provide a decompressor capable of suppressing the loss in the output of the engine and for preventing the generation of noise.

To achieve this object, according to a first aspect, a decompressor for a fourstroke cycle engine has a decompression cam supported on a camshaft interlocked with a crankshaft by an overrunning clutch to forcibly open an exhaust valve wherein the overrunning clutch has an outer member provided on its outer circumference with a projection, a cylinder head supporting the camshaft thereon is provided with a stopper, and the decompression cam is held stationary while the camshaft is rotating in a normal direction by contact between a side surface of the projection and a side surface of the stopper.

The decompression cam is held stationary while the camshaft is rotating in a normal direction by contact between a side surface of the projection and a side surface of the stopper.

Therefore, any radial pressure is not exerted on the overrunning clutch by the stopper and the overrunning clutch does not apply any pressure to the camshaft. Consequently, frictional resistance that acts against the rotation of the camshaft can be reduced and the loss in the output of the engine can be suppressed.

Since the respective side surfaces of the projection and the stopper merely slide relative to each other even if the engine generates vibrations, noise generation by the projection and the stopper can be prevented.

According to a second aspect, the overrunning clutch comprises the outer circumference of the camshaft, a annular member is loosely positioned on the outer circumference of the camshaft so as to define an annular space between the outer circumference of the camshaft and the annular member. Rollers are disposed in a space defined by grooves formed in the inner circumference of the annular member and the outer circumference of the camshaft. The rollers are capable of exercising a wedge action.

In the overrunning clutch the annular member is provided in its outer circumference with recesses for lightening or reducing the weight in sections between the grooves.

Thus, the annular member has a small moment of inertia and the annular member is capable of quickly starting rotation when the camshaft reverses.

Consequently, the response to open the exhaust valve can be improved.

According to a third aspect, the stopper is inserted in a hole formed in the cylinder head from the side of the camshaft and is held in place with a retaining ring. The stopper is held in the hole formed in the cylinder head from the side of the camshaft with a retaining ring.

Therefore, when attaching the stopper to the cylinder head, the stopper can be moved in the same direction as that in which the camshaft and other parts are moved when attaching the same to the cylinder head, and work for attaching the stopper to the cylinder head and work for forming the hole in the cylinder head can be facilitated.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 4 is a front elevational view of the overrunning clutch according to the present invention;

FIGS. 5(*a*) to 5(*c*) are schematic views for explaining a procedure for assembling a stopping mechanism according to the present invention;

DETAILED DESCRIPTION OF THE PREFERRED EMBODIMENTS

Figure 1:
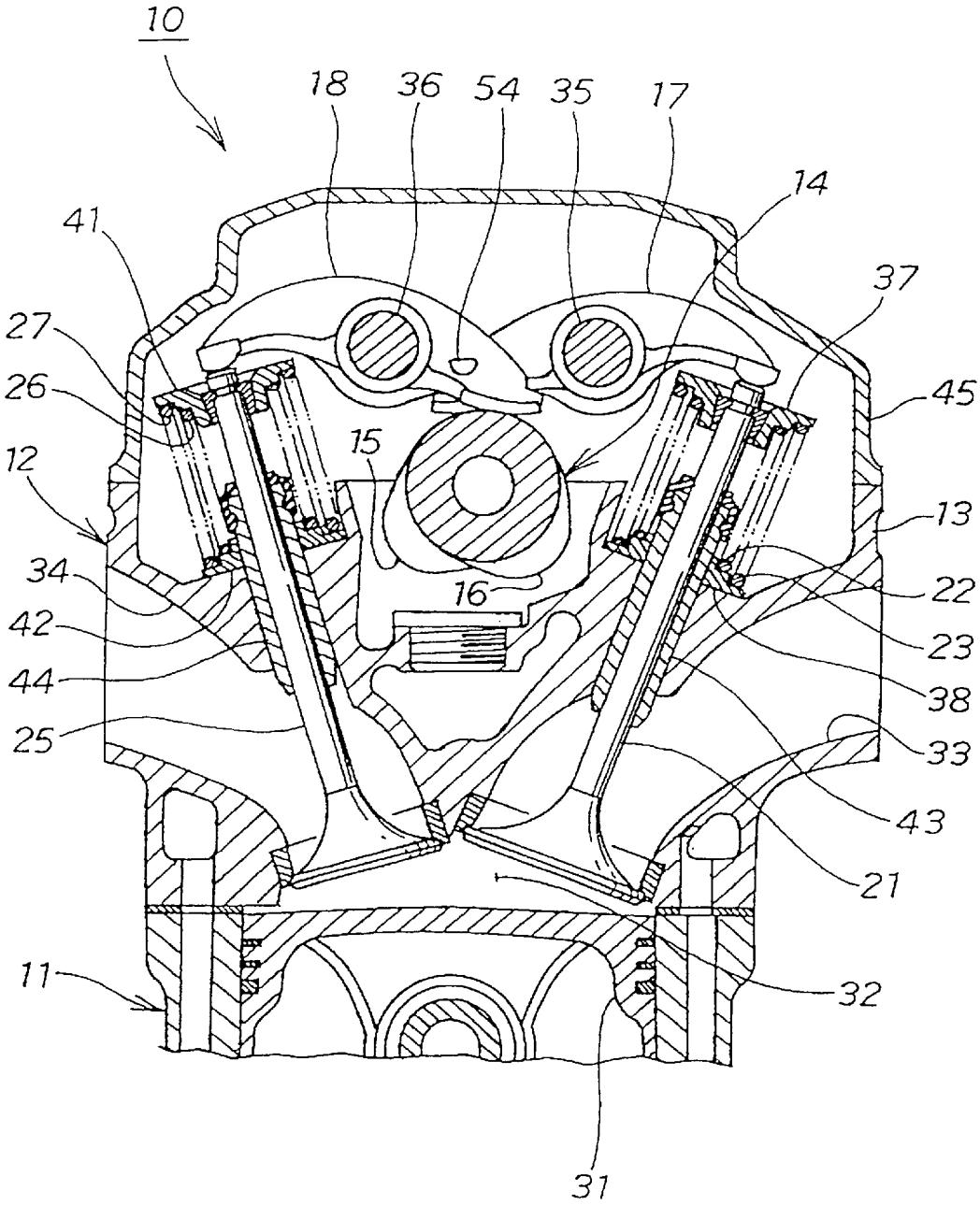
FIG. 1 is a sectional view of an upper portion of an engine provided with a decompressor according to the present invention.

A preferred embodiment of the present invention will be described with reference to the accompanying drawings, in which directions are designated with reference to the direction of reference characters.

FIG. 1 is a sectional view of an upper portion of an engine provided with a decompressor according to the present invention taken on a plane perpendicular to the axis of a camshaft 14. The engine 10 is a four-stroke cycle engine having a cylinder block 11 and a cylinder head assembly 12 fixedly mounted on the cylinder block 11.

The cylinder head assembly 12 has a cylinder head 13, a camshaft 14 supported on the cylinder head 13, interlocked with a crankshaft, not shown, by a cam chain, not shown, and provided with cams 15 and 16. A rocker arm 17 includes one end in contact with the cam 15 which is driven for rocking by the cam 15. A rocker arm 18 includes one end in contact with the cam 16 which is driven for rocking by the cam 16. A suction valve 21 is in contact with the other end of the rocker arm 17. Suction valve springs 22 and 23 bias the suction valve 21 in a closing direction. An exhaust valve 25 is in contact with the other end of the rocker arm 18. Exhaust valve springs 26 and 27 bias the exhaust valve 25 in a closing direction.

Also as illustrated in FIG. 1, a piston 31, a combustion chamber 32, a suction port 33, an exhaust port 34, rocker shafts 35 and 36, retainers 37, 38, 41 and 42, valve guides 43 and 44 and a head cover 45 are operatively mounted relative to each other.

Figure 2:
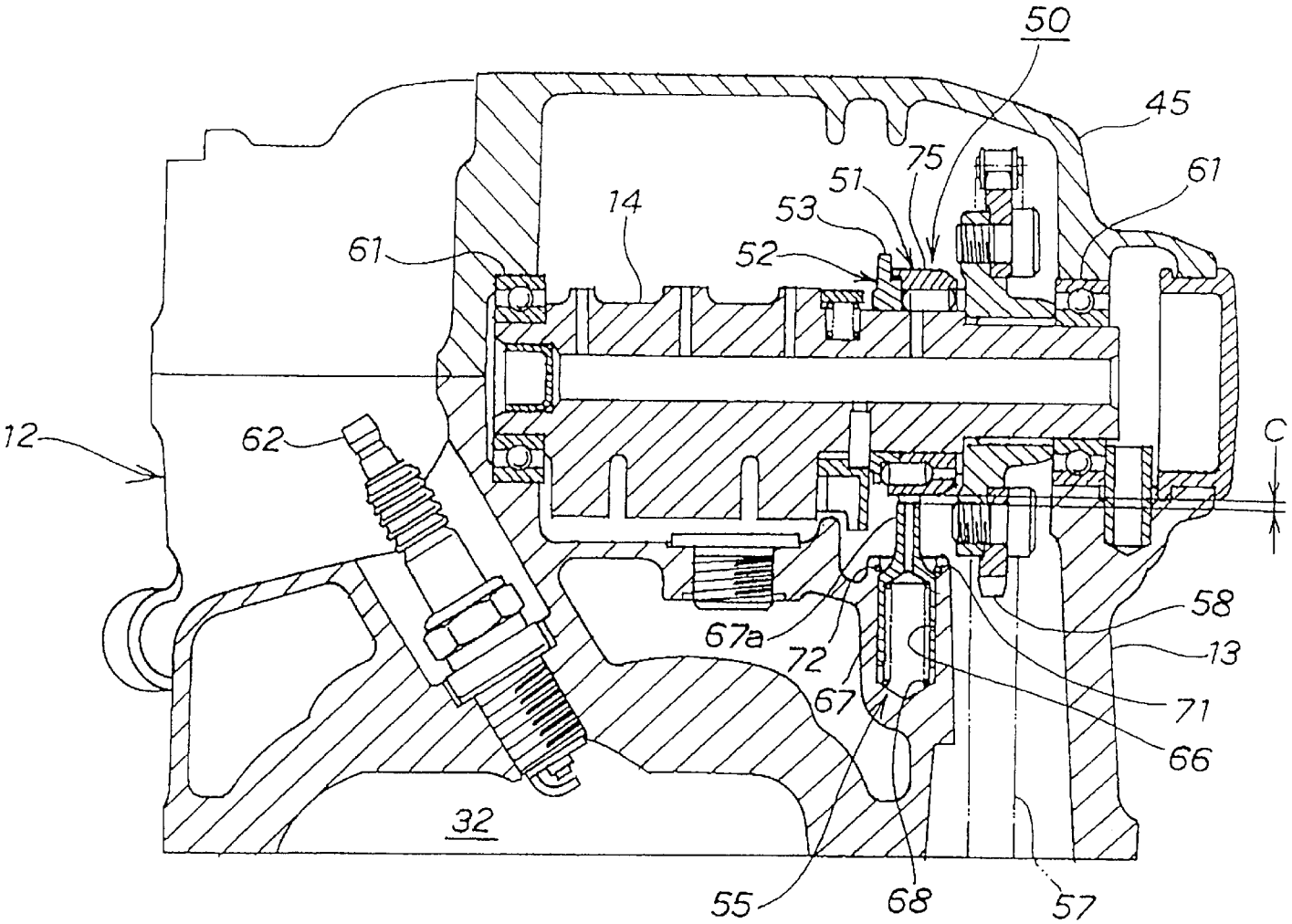
FIG. 2 is a sectional view of a cylinder head assembly included in the engine provided by the decompressor according to the present invention.

FIG. 2 is a longitudinal sectional view of the cylinder head assembly of the engine provided with the decompressor of the present invention taken on a plane including the axis of the camshaft 14. The cylinder head assembly 12 is provided with the decompressor 50 to prevent the reverse rotation of the crankshaft when the engine is started.

The decompressor 50 has an overrunning clutch 51 mounted on the camshaft 14. A decompression cam 52 is disposed beside the overrunning clutch 51. A decompression cam follower 54 (FIG. 1) is formed on a side surface of the rocker arm 18 (FIG. 1) so as to correspond to a cam part 53 of the decompression cam 52. A stopping mechanism 55 is formed in a portion of the cylinder head 13 near the overrunning clutch 51 to keep the overrunning clutch stationary while the camshaft 14 is in normal rotation. Also, as illustrated in FIG. 2, a cam chain 57, a cam sprocket 58 fixedly mounted on the cam shaft 14, bearings 61 held between the cylinder head 13 and the head cover 45 to support the camshaft 14, and an ignition plug 62 are operatively mounted relative to each other.

The stopping mechanism 55 is formed by movably fitting a stopping member 67 having the shape of a bolt in a hole 66 formed in the cylinder head 13 from the side of the camshaft 14. A spring 68 is inserted in the hole 66 so as to bias the stopping member 67 outwardly. A retaining rig 72 is fitted in an annular groove 71 formed in the inner circumference of the hole 66 at a position near the open end of the hole 66 to hold the stopping member 67 in the hole 66. The stopping member 67 has a tip part 67*a*. A clearance of a thickness C is formed between the outer circumference of the annular member 75 and the stopping member 67.

Figure 3:
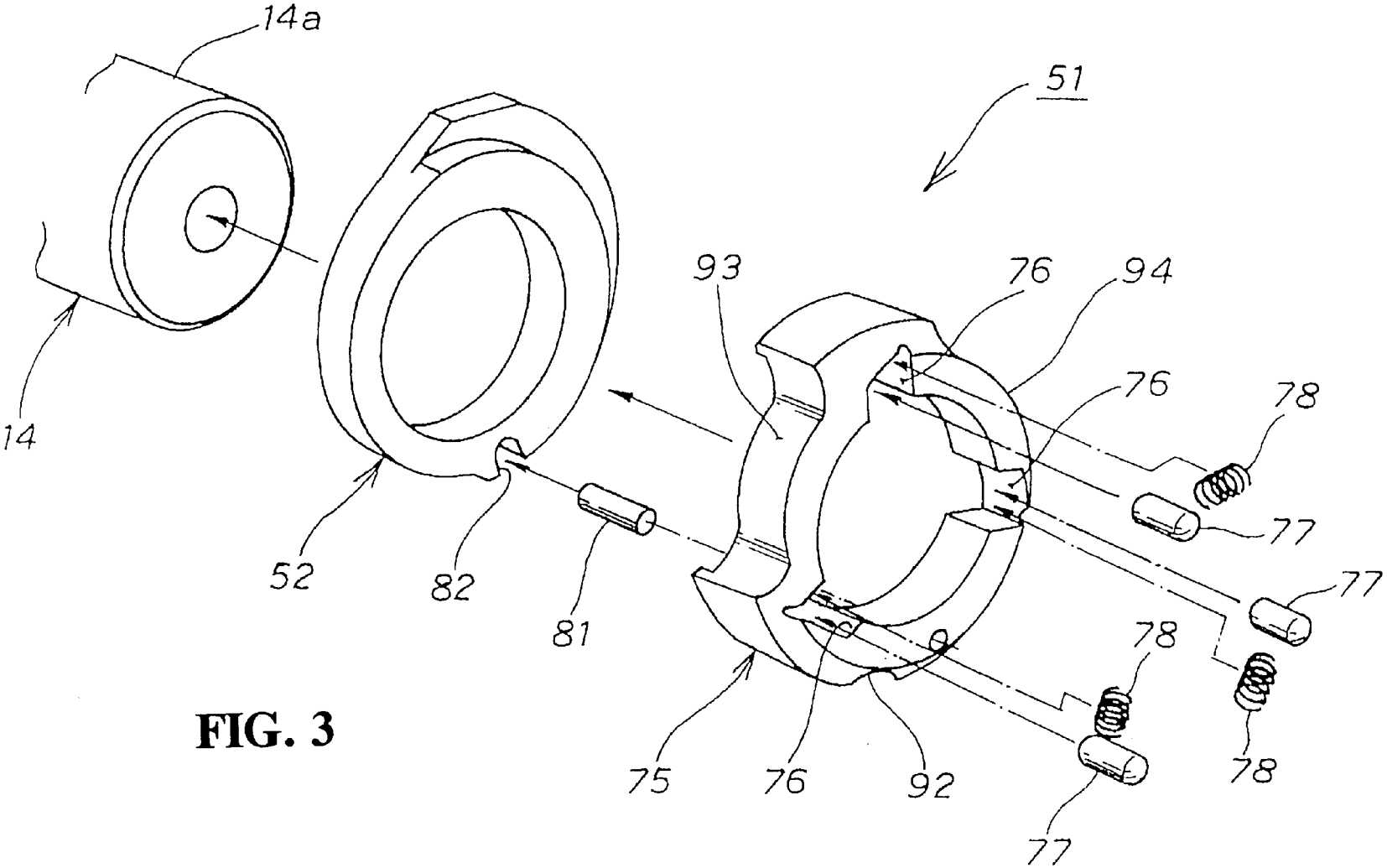
FIG. 3 is an exploded perspective view of an overrunning clutch included in the decompressor according to the present invention.

FIG. 3 is an exploded perspective view of the overrunning clutch 51 of the decompressor according to the present invention. The overrunning clutch 51 comprises the camshaft 14, the annular member 75 loosely positioned on the camshaft 14 so as to define an annular space between the outer circumference of the camshaft 14 and the annular member 75 and provided with a plurality of grooves 76 formed in the inner circumference thereof Rollers 77 are disposed in spaces defined by the grooves 76. A plurality of springs 78 bias the rollers 77 in a predetermined direction. The decompression cam 52 is disposed contiguously with the annular member 75 and is interlocked with the annular member 75 by a pin 81 so that the decompression cam 52 rotates together with the annular member 75. A groove 82 is provided for receiving the pin 81.

FIG. 4 is a front elevational view of the overrunning clutch 51 according to the present invention. Each of the grooves 76 formed in the annular member 75 of the overrunning clutch 51 has two side surfaces 84 and 85, and a bottom surface 86. The bottom surface 86 is a curved or flat surface extending from the side surface 85 toward the side surface 84 so as to approach the outer circumference 14*a* of the camshaft 14.

The roller 77 is maintained in contact with the bottom surface 86 and the outer circumference 14*a* of the camshaft 14 by the spring 78 exercises a wedge action when the cam shaft 14 rotates counterclockwise and the overrunning clutch 51 is engaged. Consequently, the annular member 75 rotates together with the camshaft 14. When the camshaft 14 rotates clockwise, the roller 77 is urged toward the side surface 85, so that the overrunning clutch 51 is disengaged.

The annular member 75 is provided, on its outer circumference, with a projection 91 that engages the stopping mechanism 55 (FIG. 2), and lightening or weight reducing recesses 92, 93 and 94. A hole 95 is formed in a side surface (back surface as viewed in FIG. 4) of the annular member 75 to receive the pin 81 (FIG. 3).

The projection 91 has a rising surface 91*a* rising from the outer circumference of the annular member 75 and an inclined surface 91*b*. The lightening recesses 92, 93 and 94 are formed to form the overrunning clutch 51 in a small moment of inertia.

A procedure for assembling the stopping mechanism will be explained with reference to FIGS. 5(*a*) to 5(*c*). The spring 68 is inserted in the hole 66 formed in the cylinder head 13 as shown in FIG. 5(*a*).

The stopping member 67 is forced into the hole 66 against the resilience of the spring 68 as shown in FIG. 5(*b*). The stopping member 67 is kept pressed in the direction of the blank arrow and the retaining ring 72 is fitted in the annular groove 71 formed in the circumference of the hole 66 as shown in FIG. 5(*c*) to complete the stopping mechanism 55.

The present invention is characterized by retaining the stopping member 67 in the hole 66 formed in the cylinder head 13 from the side of the camshaft 14 (FIG. 2) with the retaining ring 72.

When attaching the stopping member 67 to the cylinder head 13, the stopping member 67 can be moved in the same direction as that in which the camshaft 14 and other parts are moved when attaching the same to the cylinder head 13, and work for attaching the stopping member 67 to the cylinder head 13 and work for forming the hole 66 in the cylinder head 13 can be facilitated.

The operation of the decompressor 50 will be described. with reference to FIGS. 6(*a*) and 6(*b*).

Figure 6B:
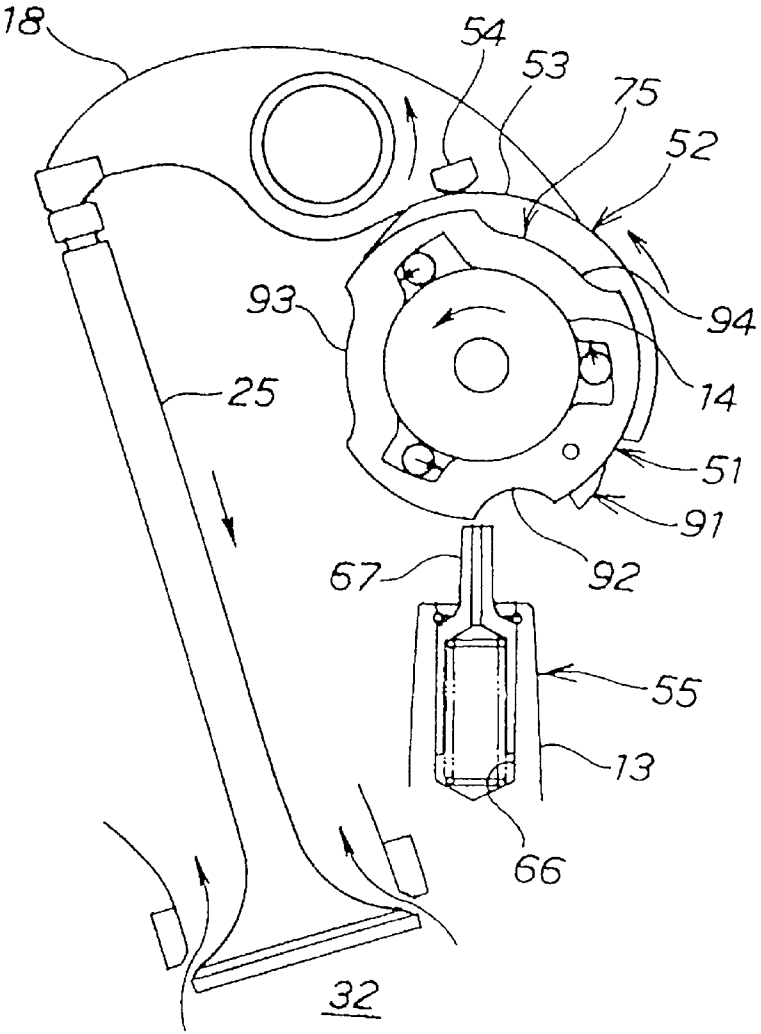
FIGS. 6(*a*) to 6(*b*) are views for explaining the operation of the decompressor according to the present invention.
Figure 6A:
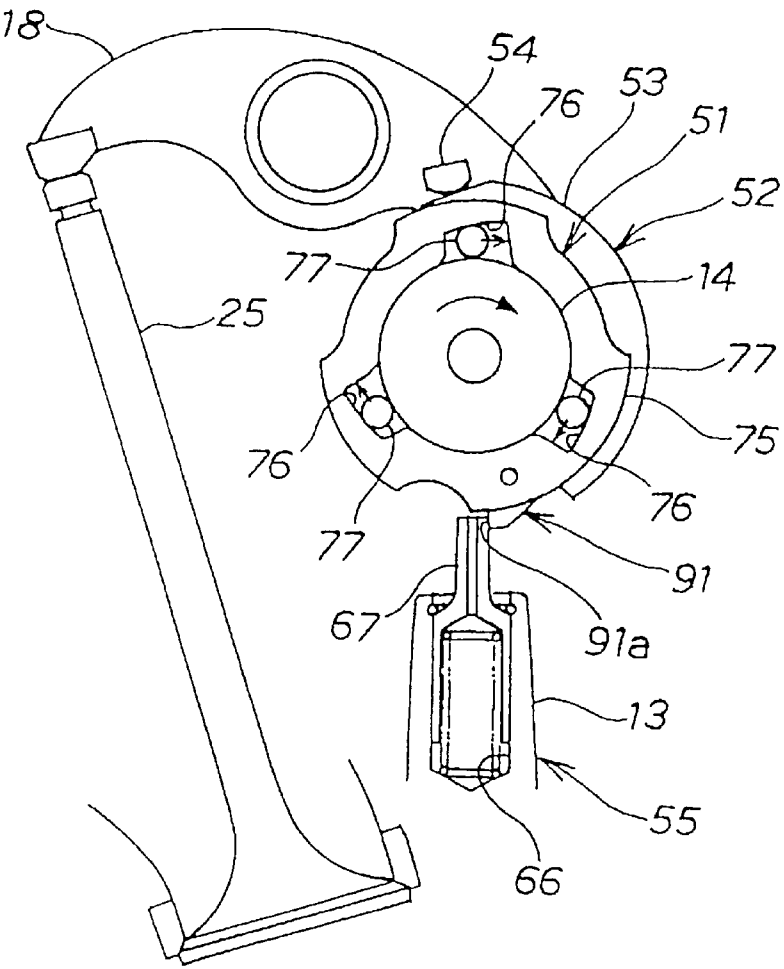

Referring to FIG. 6(*a*), when the cam shaft 14 rotates in the normal direction indicated by the arrow, the overrunning clutch 51 is disengaged and thence the rotation of the camshaft 14 is not transmitted to the annular member 75.

Since the cam shaft 14 applies a very low frictional force to the annular member 75 and a low torque attempts to rotate the annular member 75, the stopping member 67 of the stopping mechanism 55 engages the rising surface 91*a* of the projection 91 which is formed on the annular member 75 to restrain the annular member 75 from rotation.

Referring to FIG. 6(*b*), when the camshaft 14 starts rotating in the reverse direction indicated by the arrow, the overrunning clutch 51 is engaged. Consequently, the annular member 75 and the decompression cam 52 rotate together with the camshaft 14. Then, the cam part 53 of the decompression cam 52 engages and raises the cam follower 54 formed on the rocker arm 18, whereby the rocker arm 18 is turned counterclockwise. Consequently, the exhaust valve 25 is depressed by the rocker arm 18 to open the exhaust port 34 and pressure in the combustion chamber 32 is reduced. Therefore, a mixture contained in the combustion chamber 32 is not ignited and the reverse rotation of the crankshaft 14 at the start of the engine can be prevented.

Since the annular member 75 is provided in its outer circumference with the recesses 92, 93 and 94, the annular member 75 has a small moment of inertia and can start turning immediately after the start of rotation of the camshaft 14, so that the exhaust valve 25 can be depressed without delay to provide an early opening of the exhaust port 34.

Referring again to FIG. 6(*a*), if the decompressor 50 is not provided with the stopping mechanism 55, the annular member 75 will be tuned by the low frictional force applied by the camshaft 14 to the annular member 75 as the cam shaft 14 rotates in the normal direction. The decompression cam 52 combined with the annular member 75 will be turned together with the annular member 75. Consequently, the exhaust valve 25 is opened at time different from correct time and the engine may stop or malfunction.

As explained with reference to FIGS. 2, 6(*a*) and 6(*b*), to reduce the load that acts on the starting system during cranking, according to the present invention, the decompressor 50 for the four-stroke cycle engine 10 (FIG. 1), comprises the decompression cam supported 52 on the camshaft 14 interlocked with the crankshaft by the overrunning clutch 51 to forcibly open the exhaust valve 25. The overrunning clutch 51 has the annular member 75 provided on its outer circumference with the projection 91 and is united with the decompression cam 52. The cylinder head 13, supporting the camshaft 14 thereon, is provided with the stopping member 67, and the decompression cam 52 is held stationary while the camshaft 14 is rotating in the normal direction by contact between the rising side surface 91*a* of the projection 91 and the side surface of the stopping member 67.

The stopping member 67 does not apply pressure to the annular member 75 in a radial direction and the annular member 75 does not apply any force to the camshaft 14. Frictional resistance against the rotation of the cam shaft 14 can be reduced and loss in the output of the engine 10 can be suppressed. Even if vibrations are generated by the engine 10, the side surface 91 a of the projection 91 and the side surface of the stopping member 67 merely slide relative to each other and hence noise generation by the projection 91 and the stopping member 67 can be prevented.

According to the present invention, the overrunning clutch 51 is formed of the outer circumference 14*a* of the camshaft 14, the annular member 75 is loosely positioned on the outer circumference 14*a* of the camshaft 14 so as to define an annular space between the outer circumference 14*a* of the camshaft 14 and the annular member 75. The rollers 77 are disposed in the spaces define by the grooves 76 formed in the inner circumference of the annular member 75 and the outer circumference 14*a* of the camshaft 14 and are capable of exercising a wedge action. The annular member 75 is provided in its outer circumference with the recesses 92, 93 and 94 for lightening the sections between the grooves 76.

Thus, the annular member 75 has a small moment of inertia and hence the exhaust valve 25 can be opened in quick response to the rotation of the camshaft 14.

Figure 7:
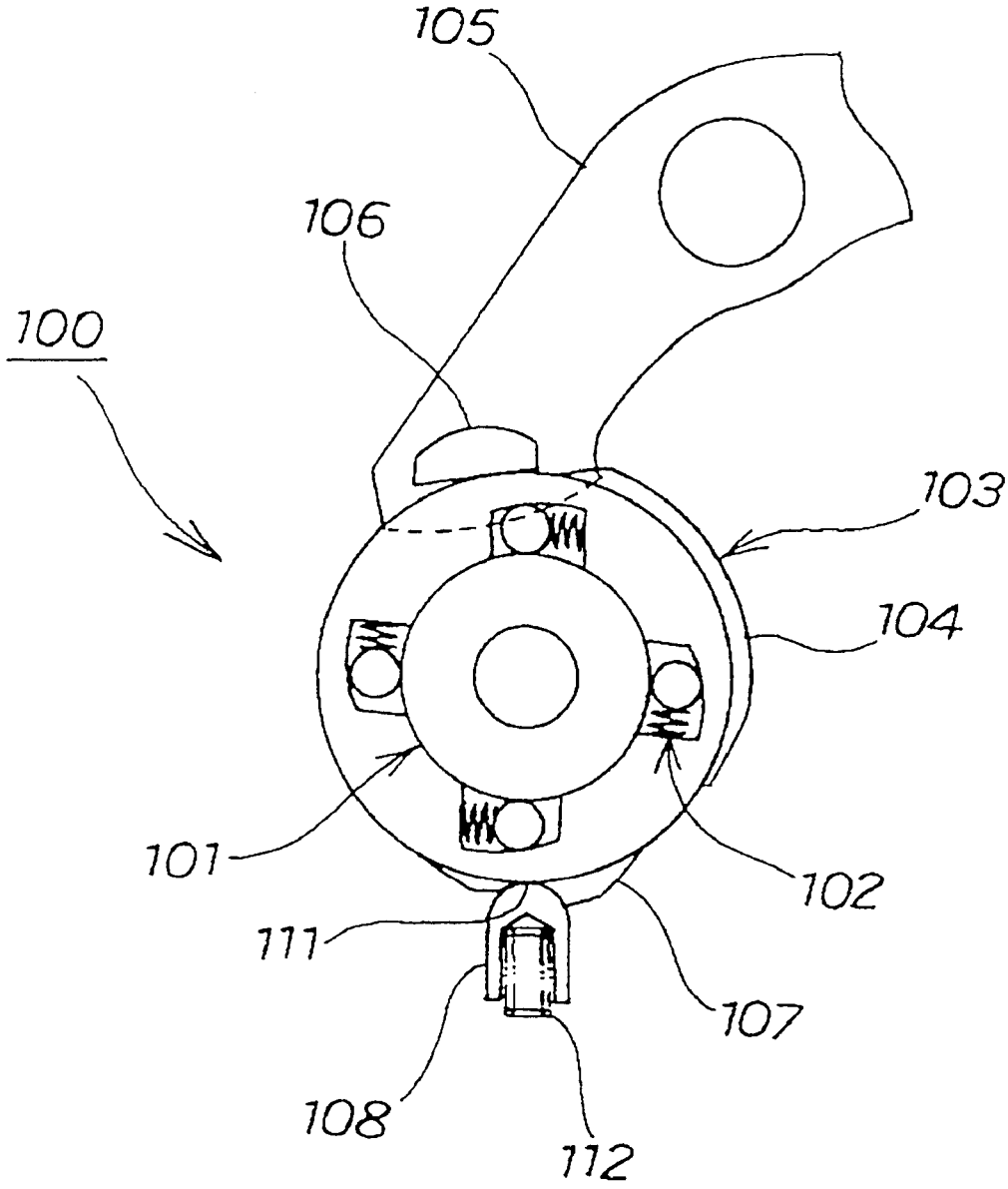
FIG. 7 is a view for explaining a decompressor in a comparative example.

FIG. 7 shows a decompressor in a comparative example.

The decompressor 100 transmits the rotation of a camshaft 101 through an overrunning clutch 102 to a decompression cam 103. The decompression cam 103 engages a cam follower 106 formed on a surface of a rocker arm 105 to open an exhaust valve, not shown, by turning the rocker arm 105.

The decompression cam 103 is kept stationary while the camshaft 101 is rotating in the normal direction by a positioning plunger 108 engaged with a projection 107 formed on the outer circumference of the decompression cam 103 and pressed by the resilience of a spring 112 against a recess 111 continuous with the projection 107.

In this decompressor 100 in the comparative example, the positioning plunger 108 is pressed against the recess 111 of the decompression cam 103. Therefore, frictional force acts between the rotating camshaft 101 and the stationary decompression cam 103, which increases loss in the output of the engine.

According to the present invention, the projection 91 is formed on the outer circumference of the annular member 75. The projection 91 may be formed on a side surface of the annular member 75 or a side surface of the decompression cam 52, provided that the stopping member 67 is able to engage the projection 91.

The present invention exercises the following effects.

In the decompressor for a four-stroke cycle engine according to the first aspect, the projection is formed on the outer circumference of the annular member of the overrunning clutch, the stopper is formed on the cylinder head supporting the camshaft so that the respective surfaces of the projection and the stopper are in contact with each other to keep the decompression cam stationary while the cam shaft is rotating in the normal direction. Therefore, the stopper does not apply pressure to the overrunning clutch in the radial direction and the overrunning clutch does not apply any force to the camshaft. Consequently, frictional resistance against the rotation of the cam shaft can be reduced and loss in the output of the engine can be suppressed.

Even if vibrations are generated by the engine, the respective side surfaces of the projection and the stopper merely slide relative to each other and hence noise generation by the projection and the stopper can be prevented.

In the decompressor for a four-stroke cycle engine according to the second aspect, the annular member is provided in its outer circumference with the lightening or weight reducing recesses in the sections between the grooves. Therefore, the annular member has a small moment of inertia and is able to start rotating quickly when the cam shaft reverses. Consequently, an exhaust valve opening response can be improved.

In the decompressor for a four-stroke cycle engine according to the third aspect, the stopping member is inserted in the hole formed in the cylinder head from the side of the camshaft and retained therein by the retaining ring. Therefore, when attaching the stopping member to the cylinder head, the stopping member can be moved in the same direction as that in which the camshaft and other parts are moved when attaching the same to the cylinder head, and the work for attaching the stopper to the cylinder head and the work for forming the hole in the cylinder head can be facilitated.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A decompressor for a four-stroke cycle engine, comprising:

a decompression cam supported on a camshaft interlocked with a crankshaft by an overrunning clutch to forcibly open an exhaust valve;

said overrunning clutch includes an outer member, said outer member being provided on an outer circumference with a projection; and a cylinder head supporting the camshaft thereon, said cylinder head being provided with a stopper;

said decompression cam is held stationary while the camshaft is rotating in a normal direction by contact between a side surface of the projection and a side surface of the stopper, wherein the stopper is inserted in a hole formed in the cylinder head opposite to a side of the camshaft and is held in place with a retaining ring.

2. The decompressor for a four-stroke cycle engine according to claim 1, wherein the overrunning clutch comprises the outer circumference of the camshaft, an annular member loosely positioned on the outer circumference of the camshaft so as to define an annular space between the outer circumference of the camshaft and the annular member, and rollers disposed in spaces defined by grooves formed in the inner circumference of the annular member and the outer circumference of the camshaft and capable of exercising a wedge action; and the annular member is provided in its outer circumference with recesses for reducing weight in sections between the grooves.

3. The decompressor for a four-stroke cycle engine according to claim 1, and further including an engaging member mounted between said decompression cam and said overrunning clutch for securing said decompression cam to said overrunning clutch.

4. The decompressor for a four-stroke cycle engine according to claim 2, and further including an engaging member mounted between said decompression cam and said overrunning clutch for securing said decompression cam to said overrunning clutch.

5. The decompressor for a four-stroke cycle engine according to claim 2, wherein said annular member includes a plurality of recesses defined in the inner circumference of the annular member, each said recess extending a predetermined distance along the inner circumference thereof, each of said recesses includes a roller disposed therein and further including a spring mounted within each recess for exercising a wedging action when the camshaft is rotated in a counterclockwise direction.

6. The decompressor for a four-stroke cycle engine according to claim 5, wherein each recess is formed by a first side surface, a second side surface and a bottom surface, said bottom surface being inclined to extend from the first side surface towards the second side surface to provide a reduced area of the recess in the counterclockwise direction.

7. A decompressor for a four-stroke cycle engine, comprising:

a decompression cam supported on a camshaft interlocked with a crankshaft by an overrunning clutch for selectively opening and closing an exhaust valve;

an outer member forming an outer circumferential surface of said overrunning clutch;

a projection formed on said outer circumferential surface of said overrunning clutch; and a stopper mounted adjacent to said outer circumferential surface of said overrunning clutch for selectively engaging said projection;

said decompression cam is held stationary while the camshaft is rotating in a normal direction by contact between the projection and the stopper, wherein the stopper is inserted in a hole formed in the cylinder head opposite to a side of the camshaft and is held in place with a retaining ring.

8. The decompressor for a four-stroke cycle engine according to claim 7, wherein the overrunning clutch comprises the outer circumference of the camshaft, an annular member loosely positioned on the outer circumference of the camshaft so as to define an annular space between the outer circumference of the camshaft and the annular member, and rollers disposed in spaces defined by grooves formed in the inner circumference of the annular member and the outer circumference of the camshaft and capable of exercising a wedge action, and the annular member is provided in its outer circumference with recesses for reducing weight in sections between the grooves.

9. The decompressor for a four-stroke cycle engine according to claim 7, and further including an engaging member mounted between said decompression cam and said overrunning clutch for securing said decompression cam to said overrunning clutch.

10. The decompressor for a four-stroke cycle engine according to claim 8, and further including an engaging member mounted between said decompression cam and said overrunning clutch for securing said decompression cam to said overrunning clutch.

11. The decompressor for a four-stroke cycle engine according to claim 8, wherein said annular member includes a plurality of recesses defined in the inner circumference of the annular member, each said recess extending a predetermined distance along the inner circumference thereof, each of said recesses includes a roller disposed therein and further including a spring mounted within each recess for exercising a wedging action when the camshaft is rotated in a counterclockwise direction.

12. The decompressor for a four-stroke cycle engine according to claim 11, wherein each recess is formed by a first side surface, a second side surface and a bottom surface, said bottom surface being inclined to extend from the first side surface towards the second side surface to provide a reduced area of the recess in the counterclockwise direction.

* * * * *